US008779316B2

(12) United States Patent
Drews et al.

(10) Patent No.: US 8,779,316 B2
(45) Date of Patent: Jul. 15, 2014

(54) HIGH-VOLTAGE CIRCUIT BREAKER

(75) Inventors: Ing Lutz Drews, Dransfeld (DE); Gregoire Cyril, Villeurbanne (FR)

(73) Assignee: Alstom Grid GmbH, Frankfurt (DE)

( * ) Notice: Subject to any disclaimer, the term of this patent is extended or adjusted under 35 U.S.C. 154(b) by 844 days.

(21) Appl. No.: 12/222,771

(22) Filed: Aug. 15, 2008

(65) Prior Publication Data

US 2009/0107957 A1 Apr. 30, 2009

(30) Foreign Application Priority Data

Oct. 31, 2007 (EP) ..... 07021276

(51) Int. Cl.
*H01H 33/88* (2006.01)
*H01H 33/91* (2006.01)

(52) U.S. Cl.
USPC ..... 218/51; 218/59

(58) Field of Classification Search
CPC ..... H01H 33/00; H01H 33/70; H01H 33/88; H01H 33/91; H01H 33/95; H01H 33/53
USPC ..... 218/50–57, 59–64, 65, 68, 69, 72–77, 3
See application file for complete search history.

(56) References Cited

U.S. PATENT DOCUMENTS

| | | | | |
|---|---|---|---|---|
| 3,396,253 | A | 8/1968 | Schubert et al. | |
| 5,814,781 | A * | 9/1998 | Koyanagi et al. | 218/60 |
| 7,902,478 | B2 * | 3/2011 | Kriegel et al. | 218/43 |
| 2005/0173378 | A1 * | 8/2005 | Nowakowski | 218/43 |

FOREIGN PATENT DOCUMENTS

| | | | |
|---|---|---|---|
| DE | 6603028 | 8/1969 | |
| EP | 1814132 A1 * | 8/2007 | 218/43 |
| GB | 2215133 | 9/1989 | |
| WO | WO 03096365 | 11/2003 | |

OTHER PUBLICATIONS

European Search Report published Mar. 31, 2008.

* cited by examiner

*Primary Examiner* — Amy Cohen Johnson
*Assistant Examiner* — Marina Fishman
(74) *Attorney, Agent, or Firm* — Harness, Dickey & Pierce, P.L.C.

(57) ABSTRACT

Described is a high-voltage circuit breaker provided with two opposite-arranged arcing contacts, which are surrounded by an insulating nozzle. Furthermore provided are two main contacts, arranged opposite each other outside of the insulating nozzle, with respectively one of these contacts being assigned to one of the two arcing contacts. The high-voltage circuit breaker is provided, in at least one embodiment, with at least one device for diverting an insulating gas flow from the region between the two arcing contacts, wherein a respective insulating gas flow is conducted outside of the insulating nozzle and in the direction toward the main contacts. A diverting device is provided, which is equipped with a mechanism for diverting insulating gas from the insulating gas flow that is diverted from the region between the two arcing contacts, such that the two insulating gas flows moving from both directions toward the main contacts have approximately the same effect on the insulating gas that is present in the region of the two main contacts, thereby ensuring that the insulating gas is not displaced significantly in this region.

20 Claims, 2 Drawing Sheets

HIGH-VOLTAGE CIRCUIT BREAKER

PRIORITY STATEMENT

The present application hereby claims priority under 35 U.S.C. §119 on European patent application number 07 021 276.6-2214 filed Oct. 31, 2007, the entire contents of which is hereby incorporated herein by reference.

FIELD

Embodiments of the invention generally relate to a high-voltage circuit breaker. At least one embodiment relates to a high-voltage circuit breaker filled with insulating gas, comprising two opposite-arranged arcing contacts, which are surrounded by an insulating nozzle and two main contacts arranged opposite each other outside of the insulating nozzle, wherein respectively one main contact is assigned to one of the arcing contacts, further comprising at least one device for diverting an insulating gas flow from the region between the two arcing contacts, wherein respectively one insulating gas flow outside of the insulating nozzle is conducted from both directions in the direction toward the main contacts.

BACKGROUND

High-voltage circuit breakers are generally known. The at least one device for diverting the outward expanding insulating gas flow from the region between the two arcing contacts is designed to conduct the insulating gases, which are heated by an electric arc, to other regions of the high-voltage circuit breaker. In this way, the hot insulating gas not only can relax, but is also cooled down because it mixes with cold insulating gas that is present in the flow-through regions and because of a heat transfer to the components of the high-voltage circuit breaker through which it flows.

For a state of the high-voltage circuit breaker in which the two main contacts and the two arcing contacts are no longer connected, it is thus critical that the insulation capacity achieved with the insulating gas between the two main contacts is always high enough, so that an electrical separation is constantly ensured. This is tantamount to saying that the insulating capacity of the insulating gas between the two separated main contacts, meaning the so-called electrical resistance of the two main contacts, must always be ensured.

The requirement to use as little of the insulating gas as possible has resulted in smaller and smaller regions of the high-voltage circuit breaker that are filled with insulating gas while, at the same time, the density of the insulating gas is also selected to be lower and lower. It is thus possible that the two insulating gas flows, which are conducted outside of the insulating nozzle from both directions approximately along the longitudinal axis in the direction toward the main contacts, no longer have sufficient insulating capacity, so that the electrical separation of the two main contacts is no longer ensured in the above-explained state of the high-voltage circuit breaker. In particular, at least one of the two insulating gas flows entering the region of the two main contacts can contain insulating gas that is at least hot enough, so that the electrical separation of the two main contacts is no longer securely guaranteed. Among other things, this follows from the fact that hot insulating gas has a lower insulating capacity than cold insulating gas.

SUMMARY

In at least one embodiment of the present invention, a high-voltage circuit breaker is created for which the electrical separation of the two main contacts is always ensured in a state, in which the two main contacts and the two arcing contacts are no longer connected.

With a high-voltage circuit breaker of at least one embodiment of the invention, a diverting device is provided with at least one mechanism for diverting insulating gas from the insulating gas flow that is diverted from the region between the two arcing contacts, so that the two insulating gas flows that flow in the direction toward the main contacts have an approximately equal effect on the insulating gas existing in the region of the two main contacts, so as to prevent any substantial displacement of the insulating gas in this region.

Prior to the transition of the high-voltage circuit breaker to the switched-off end position, the insulating gas on the inside of the switch is essentially cold. As a result of the electric arc generated during a separating operation, at least the insulating gas between the arcing contacts on the inside of the insulating nozzle is heated up. This insulating gas expands and, among other things, then generates the two insulating gas flows that are conducted on the outside of the insulating nozzle from both directions approximately along the longitudinal axis in the direction toward the main contacts. Since the effect of these two insulating gas flows according to at least one embodiment of the invention is approximately the same, the insulating gas in the region of the separated main contacts is essentially not displaced, but remains in place. This gas is cold insulating gas, which is separated by the insulating nozzle from the electric arc and is thus also not heated. As a result, the cold insulating gas remains essentially unchanged in the region of the two separated main contacts because of the approximately uniform effect of the two incoming insulating gas flows. If at all, the cold insulating gas is heated up only temporarily and only slightly. This corresponds to the fact that the insulating capacity of the insulating gas between the separated main contacts essentially remains unchanged.

The cold insulating gas in the region between the two separated main contacts is advantageously also compressed, owing to the two incoming insulating gas flows, so that the insulating capacity of this gas is improved even further.

On the whole, the electrical separation of the main contacts is thus always ensured if the high-voltage circuit breaker according to the invention is in the switched-off end position.

BRIEF DESCRIPTION OF THE DRAWINGS

Additional features, application options, and advantages of the invention follow from the description below of example embodiments of the invention, which are shown in the Figures for the drawings. All described or shown features by themselves or in any optional combination thereof represent the subject matter of embodiments of the invention, regardless of how they are combined in the patent claims or the references back, as well as regardless of their formulation and/or representation in the description and/or the drawings.

DETAILED DESCRIPTION OF THE EXAMPLE EMBODIMENTS

Figure 1:
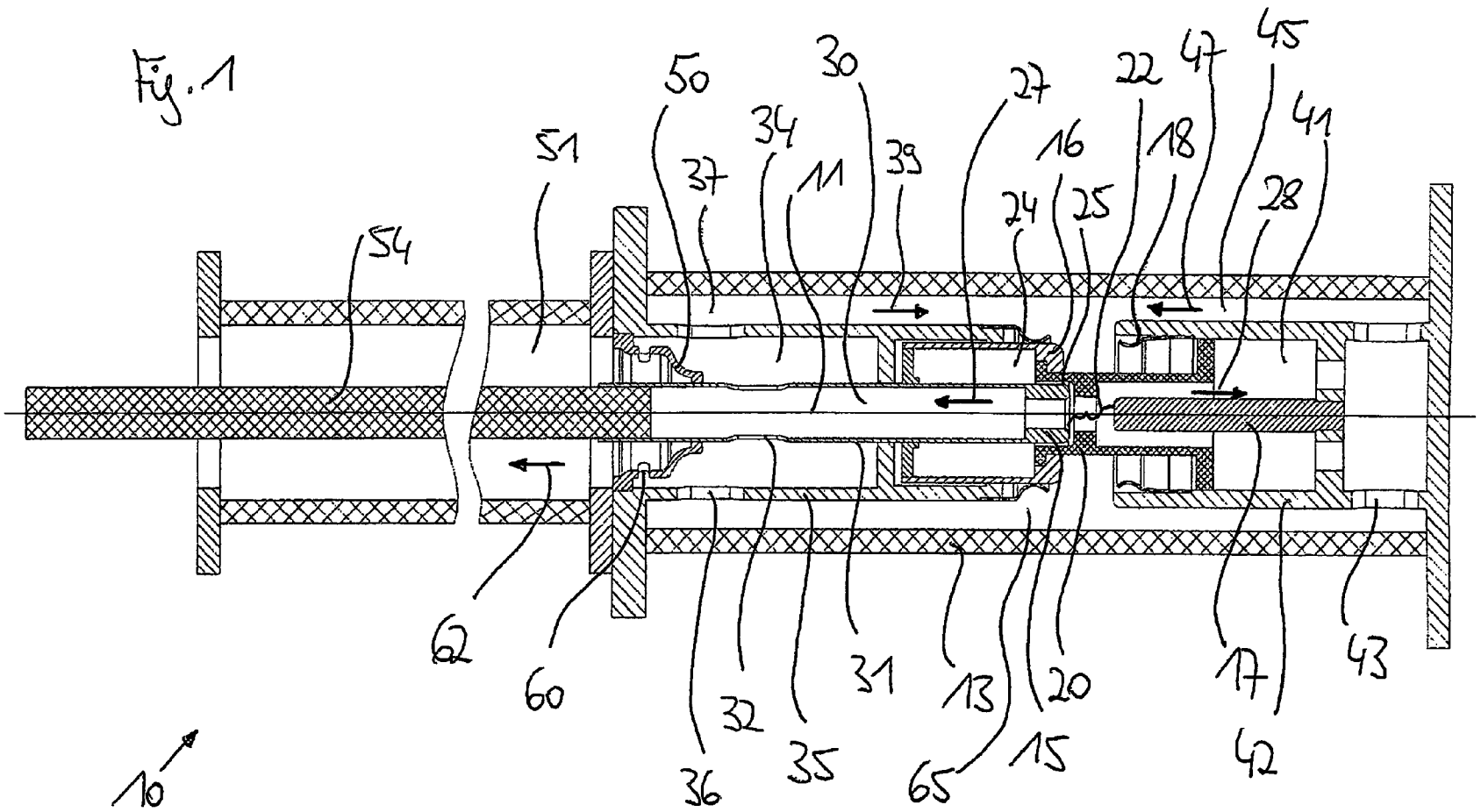
FIG. 1 shows a schematic longitudinal section through an example embodiment of a high-voltage circuit breaker according to the invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 illustrates an essentially rotation-symmetrical example embodiment of a high-voltage circuit breaker 10 with a longitudinal axis 11. A tulip-shaped arcing contact 15 with associated first main contact 16 and a pin-shaped arcing contact 17 with associated second main contact 18 are installed on the inside of a porcelain casing 13 that is filled with insulating gas. Sulfur hexafluoride (SF6) or nitrogen (N2) or tetrafluoromethane (CF4) or a mixture thereof can be used for the insulating gas.

The main contacts 16, 18 are arranged in radial direction outside of the arcing contacts 15, 17. The contacts 15, 16 as well as the contacts 17, 18 are arranged coaxial to each other and can be displaced jointly, relative to each other, in the direction of the longitudinal axis 11, meaning from a short-circuited and thus switched-on end position to a separated and thus switched-off end position and back again. In the switched-on end position, all contacts 15, 16, 17, 18 are in contact with each other, so that current can flow via the contacts. In the switched-off end position, the contacts 15, 16 and the contacts 17, 18 are separated, so that no current can flow.

An insulating nozzle 20 is connected to the tulip-shaped arcing contact 15 and the associated first main contact 16. This nozzle surrounds the two arcing contacts 15, 17 and is furthermore embodied such that the pin-shaped arcing contact 17 can dip into the insulating nozzle 20, thereby sealing it. In the switched-on end position, no insulating gas can thus flow through the insulating nozzle 20. An electric arc 22 is generated during the transition from the switched-on end position to the switched-off end position, which heats the insulating gas and thus results in an expansion of the insulating gas on the inside of the tulip-shaped arcing contact 15. During this transition, the pin-shaped arcing contact 17 furthermore moves out of the insulating nozzle 20, so that the insulating gas can subsequently flow through the insulating nozzle 20.

In FIG. 1, the contacts 15, 16, 17, 18 are shown in the switched-off end position, meaning that in FIG. 1, the contacts 15, 16 have been moved to the left while the contacts 17, 18 have been moved to the right, relative to each other. As previously mentioned, the electric arc 22 is generated between the arcing contacts 15, 17 as a result of this movement to separate the contacts 15, 16, 17, 18. As soon as the pin-shaped arcing contact 17 moves out of the insulating nozzle 20, insulating gas is blown onto this electric arc 22. This insulating gas is fed from a storage chamber 24 via a channel 25 to that region of the insulating nozzle 20, in which the electric arc 22 is present. In this region between the two arcing contacts 15, 17, the insulating gas is heated by the electric arc 22 and expands in the direction toward the tulip-shaped arcing contact 15, as well as in the direction toward the pin-shaped arcing contact 17, meaning to the left and to the right in FIG. 1. In FIG. 1 this is indicated with two arrows 27, 28, which are meant to show the respective insulating gas flows. These two hot insulating gas flows 27, 28 are diverted and conducted away from the region between the two arcing contacts 15, 17.

The insulating gas flow 27 reaches a first gas chamber 30, which is delimited by a tube 31 that carries the tulip-shaped arcing contact 15. The insulating gas flow 27 flows through openings 32 in the tube 31 into a second gas chamber 34, which is delimited by the tube 31 and a support 35 that carries the tulip-shaped arcing contact 15, the first main contact 16, and the insulating nozzle 20 and is thus located in radial direction outside of the first gas chamber 30. Through openings 36 in the support 35, the insulating gas flow 27 reaches a third gas chamber 37, formed between the support 35 and the porcelain casing 13, and is thus located radially outside of the second gas chamber 34. In this gas chamber 37, the insulating gas again flows back in the direction of the main contacts 16, 18, which is indicated in FIG. 1 with an arrow 39 intended to show the respective insulating gas flow. The insulating gas flow 39 thus flows approximately parallel to the longitudinal axis 11 and in the direction toward the two main contacts 16, 18.

The insulating gas flow 28 travels to a fourth gas chamber 41, which is formed by a carrier 42 that supports the pin-shaped arcing contact 17 and the associated second main contact 18. Through openings 43 in the carrier 42, the insulating gas flow 28 flows into a fifth gas chamber 45 that is formed between the carrier 42 and the porcelain casing 13 and is thus located radially outside of the fourth gas chamber 41. In this fifth gas chamber 45, the insulating gas flows back again in the direction toward the main contacts 16, 18, as indicated in FIG. 1 with an arrow 47 that shows the respective insulating gas flow. The insulating gas flow 47 thus flows parallel to the longitudinal axis 11 and in the direction toward the two main contacts 16, 18.

A diverting device 50 is provided in the region of the openings 36, meaning in the region of transition from the second gas chamber 34 to the third gas chamber 37. With the aid of this diverting device 50, insulating gas can be diverted from the insulating gas flow 27, arriving via the second gas chamber 34, to a sixth gas chamber 51. The sixth gas chamber 51 is located in axial direction directly following the second and third gas chambers 34, 37. The insulating gas flow 39 that flows out of the third gas chamber 37 is thus reduced by the insulating gas diverted into the sixth gas chamber 51, as compared to the insulating gas flow 27 that arrives via the second gas chamber 34.

Figure 2:
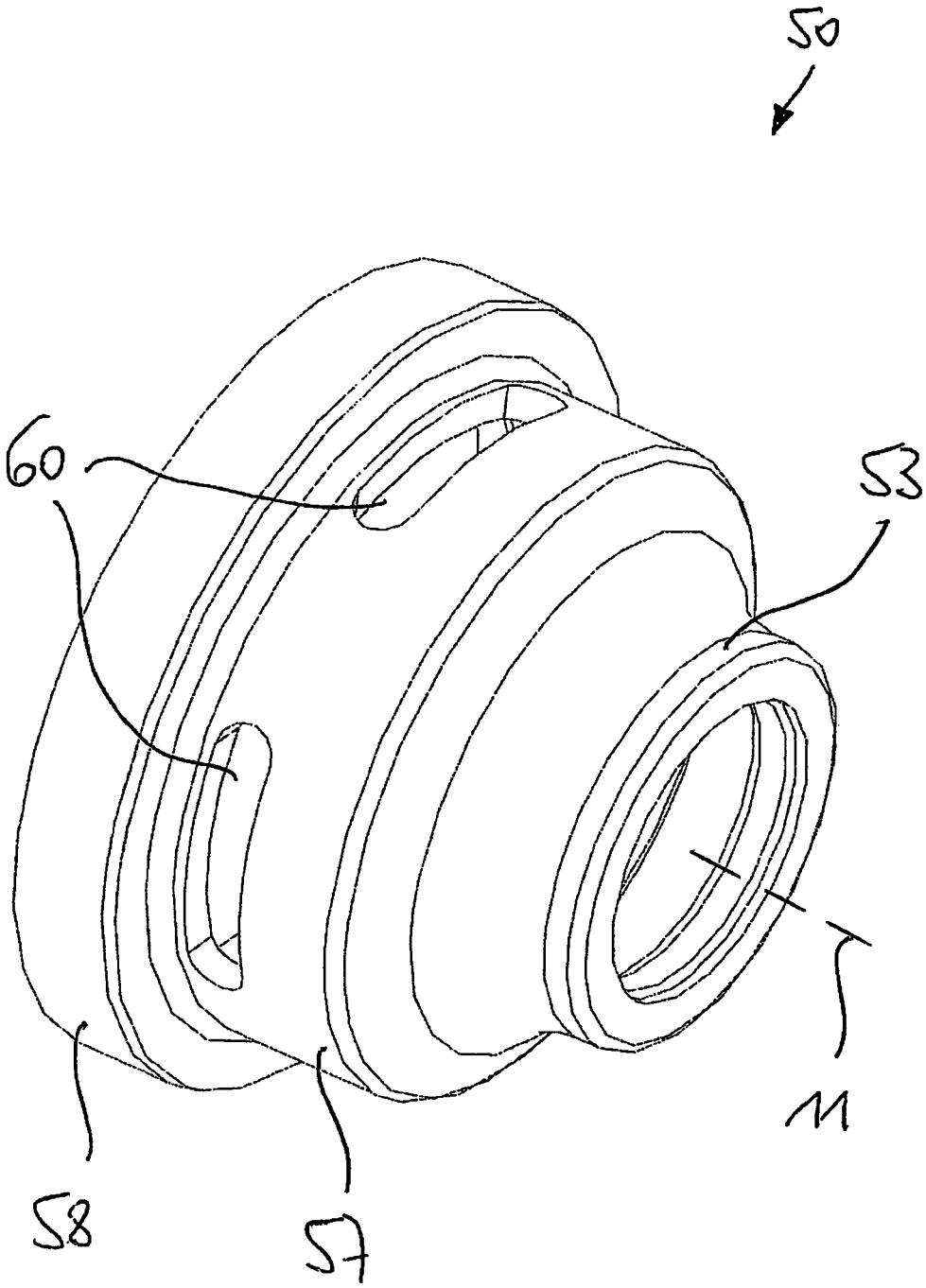
FIG. 2 shows a perspective representation of an example embodiment of a diverting device for the high-voltage circuit breaker shown in FIG. 1.

The diverting device 50 is shown in further detail in FIG. 2. The diverting device 50 has an essentially rotation-symmetrical shape, is arranged coaxial to the longitudinal axis 11 and is preferably made of aluminum. Alternatively, the diverting device 50 can also be produced from a type of plastic, for example PTFE. The diverting device 50 is provided with a guide cylinder 53, through which the tube 31 is inserted as shown in FIG. 1, wherein this tube is connected in the region of the diverting device 50 to a drive rod 54 that projects into the sixth gas chamber 51. The drive rod 54 is thus connected via the tube 31 to the tulip-shaped arcing contact 15 and the associated first main contact 16.

The rod-shaped arcing contact 17 and the associated second main contact 18 of the present example embodiment are embodied so as to be immovable. For the high-voltage circuit breaker 10 described in the present example embodiment, the transition from the switched-on end position to the switched-off end position and vice versa solely results from the movement of the tulip-shaped arcing contact 15 and the associated first main contact 16.

Alternatively, the pin-shaped arcing contact 17 and the associated second main contact 18 can also be embodied movable, but in such a way that the movement of the tulip-shaped arcing contact 15 and the associated main contact 16 is transmitted with the aid of a gear or gear assembly to the pin-shaped arcing contact 17 and the associated second main contact 18, causing them to execute a movement in the opposite direction.

Following the guide cylinder 53, the diverting device 50 in FIG. 2 is successively provided with an axially aligned cylinder 57 as well as a radially aligned disk 58. The cylinder 57 has a smaller diameter than the disk 58. The cylinder 57 is provided, for example, with kidney-shaped openings 60. Via the disk 58, the diverting device 50 is connected gas-impermeable to the support 35 and the porcelain casing 13, so that insulating gas can be supplied to the sixth gas chamber 51 only via the openings 60.

According to FIG. 1, the insulating gas can flow from the region of the openings 36, meaning the region of transition from the second gas chamber 34 to the third gas chamber 37, through the openings 60 into the cylinder 57 and into the sixth gas chamber 51. In FIG. 1, an arrow 62 indicates the insulating gas that is flowing out.

The volume and/or the amount of the insulating gas flowing into the sixth gas chamber 51 depend on the flow resistance offered by the diverting device 50 for the insulating gas. This flow resistance in turn depends essentially on the cross-sectional surface of the openings 60 in the diverting device 50. The larger the cross-sectional surface, the more insulating gas flows into the sixth gas chamber 51. Vice versa, the smaller this cross-sectional surface, the less insulating gas flows into the sixth gas chamber 51.

As explained, the insulating gas flow 27 is guided through the first, the second, and the third gas chambers 30, 34, 37 and then flows back again toward the main contacts 16, 18 as insulating gas flow 39. Along the path from the insulating gas flow 27, a specific volume and/or a specific amount of the insulating gas flow 27 is diverted via the diverting device 50 into the sixth gas chamber 51, so that the insulating gas flow 39 is reduced by the insulating gas diverted to the sixth gas chamber 51, as compared to the insulating gas flow 27. As furthermore explained, the insulating gas flow 28 is conducted through the fourth and fifth gas chambers 41, 45 and then flows back as insulating gas flow 47 in the direction toward the main contacts 16, 18.

The cross-sectional surface for the openings 60 in the diverting device 50 is selected such that the insulating gas flow 39 is approximately the same as the insulating gas flow 47. Thus, enough insulating gas is diverted with the aid of the diverting device 50 into the sixth gas chamber 51, so that the two insulating gas flows streaming in the direction of arrows 39, 47 toward the main contacts 16, 18 are approximately equal and/or their effect onto the insulating gas present in the seventh gas chamber 65 described below, is approximately the same.

As a result, the insulating gas that is located radially outside of the insulating nozzle 20 in a seventh gas chamber with reference 65 in FIG. 1, is admitted from both directions with an approximately equally large insulating flow 39, 47 and thus remains essentially locally confined in the seventh gas chamber 65. The insulating gas in the seventh gas chamber 65 is therefore essentially not displaced, but is basically maintained in the region of the seventh gas chamber 65 by the approximately equally large insulating gas flows arriving from opposite directions, as shown with arrows 39, 47 and, if applicable, is compressed by the two insulating gas flows 39, 47.

As mentioned in the above, the insulating gas flows 27, 28 are generated through heating of the insulating gas by the electric arc 22. The insulating gas flows 27, 28 therefore contain hot insulating gas. In contrast thereto, the insulating gas in the seventh gas chamber 65 is not heated by the electric arc 22 because it is separated from the electric arc 22 by the insulating nozzle 20. The insulating gas in the seventh gas chamber 65 is therefore a cold insulating gas.

Owing to the previously explained insulating gas flows 39, 47, the cold insulating gas in the seventh gas chamber 65 is therefore not displaced, but is maintained steady therein and compressed if applicable. As a result, no hot insulating gas essentially reaches the region of the seventh gas chamber 65, meaning the region around the two main contacts 16, 18, which corresponds approximately to the seventh gas chamber 65 as explained, remains filled with cold insulating gas. Thus, essentially no hot insulating gas reaches the region between the two main contacts 16, 18. The insulation between the two main contacts 16, 18 therefore essentially depends on the existing cold insulating gas and is influenced only marginally, if at all, by the hot insulating gas.

In the above explained example embodiment, the two insulating gas flows 39, 47 are adjusted to be approximately the same in order to achieve that the insulating gas in the seventh gas chamber 65 is not displaced. As shown in FIG. 1, it is assumed that the diameter of the high-voltage circuit breaker 10 in the direction of the longitudinal axis 11 remains essentially the same. The approximately equally large insulating gas flows 39, 47 therefore essentially also have the same effect on the insulating gas in the seventh gas chamber 65.

However, in dependence on the dimensioning or other design features of the high-voltage circuit breaker 10, it is possible that approximately equally large insulating gas flows could lead to a displacement of the insulating gas in the seventh gas chamber 65. For that reason, the two insulating gas flows 39, 47 generally are not the determining factor, but their effects on the insulating gas in the seventh gas chamber. It is critical in this case that the two insulating gas flows 39, 47 that flow in the direction toward the main contacts 16, 18 have an approximately uniform effect on the insulating gas in the seventh gas chamber 65, so that the insulating gas in this chamber 65 essentially is not displaced. With the aid of the diverting device 50, enough insulating gas is diverted so that the two insulating gas flows 39, 47 have approximately the same effect on the insulating gas located in the region between the two main contacts 16, 18, meaning this insulating gas is not displaced but remains in this located.

As previously explained, the volume and/or the amount of the insulating gas diverted to the sixth gas chamber 51 can be influenced by the design of the diverting device 50, in particular by the influence of the openings 60, as explained in the above. It is understood that two cylinders and/or two disks with additional openings can also be used, wherein the openings can be arranged in different planes—radial or axial—and/or the openings can be arranged in series or parallel. Openings can also be provided alternative or additionally in the disk 58 of the diverting device 50, wherein the diverting device 50 can furthermore contain additional parts provided with openings, which can aid in influencing the volume and/or amount of the insulating gas flowing off into the sixth gas chamber. It is furthermore understood that alternative or additional measures can be taken to influence the volume and/or the amount of insulating gas flowing off into the sixth gas chamber 51. Thus, the openings in the cylinders and disks can be arranged so as to be offset along the periphery, which can influence the volume and/or amount of insulating gas flowing off into the sixth gas chamber 51. If necessary, other opening designs can be used to influence the volume and/or amount of insulating gas diverted into the sixth gas chamber 51.

The openings can furthermore be embodied variable, in particular by using different opening cross sections between the switched-on end position and the switched-off end position. This can be achieved by providing the diverting device 50 with a longitudinally displaceable or a rotating component which, together with the movement of the two arcing contacts 15, 17 that move relative to each other, carries out a corresponding movement in longitudinal direction or a rotating movement, thereby opening and/or closing the openings 60 more or less.

In view of the diverting device 50, a plurality of options and measures therefore exist for influencing the volume and/or the amount of the insulating gas flowing off into the sixth gas chamber 51.

As previously explained, the diverting device 50 is arranged in the path for the insulating gas flow 27. It is understood that a corresponding diverting device can also be installed in the path of the insulating gas flow 28 or that respectively one diverting device can be arranged in each of the paths for the insulating gas flows 27, 28. It is furthermore understood that the diverting device 50 does not have to be arranged at the previously mentioned location in FIG. 1 on the high-voltage circuit breaker 10, but can also be arranged at another location in the path of one of the two insulating flows 27, 28.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. High-voltage circuit breaker filled with insulating gas, comprising:

two oppositely-arranged arcing contacts, surrounded by an insulating nozzle;

two oppositely-arranged main contacts, outside of the insulating nozzle, each oppositely-arranged main contact being assigned to one of the arcing contacts;

at least one mechanism configured to partition an insulating gas flow from a region between the two arcing contacts into first and second insulating gas flows of opposite directions, wherein the first and second insulating gas flows are conducted outside of the insulating nozzle from opposite directions toward the main contacts; and at least one diverting device configured to reduce the first insulating gas flow by diverting insulating gas from the first insulating gas flow, such that the first and second insulating gas flows flowing from opposite directions toward the main contacts do not displace the insulating gas present in a region around the two main contacts, wherein the least one diverting device is configured to divert insulating gas from the first insulating gas flow, such that the first and second insulating gas flows flowing from opposite directions toward the main contacts have approximately the same value with respect to at least one of volume and amount.

2. High-voltage circuit breaker according to claim 1, wherein the at least one diverting device includes an opening configured to divert insulating gas.

3. High-voltage circuit breaker according to claim 2, wherein the cross sectional surface of the opening is selected such that the two insulating gas flows flowing in the direction toward the main contacts are approximately the same.

4. High-voltage circuit breaker according to claim 1, wherein the at least one diverting device includes a plurality of openings to divert insulating gas.

5. High-voltage circuit breaker according to claim 4, wherein the openings are arranged in different planes.

6. High-voltage circuit breaker according to claim 4, wherein the openings are arranged offset relative to each other.

7. High-voltage circuit breaker according to claim 1, wherein the at least one diverting device is made of metal.

8. High-voltage circuit breaker according to claim 1, wherein both arcing contacts are movable together with the respectively associated main contacts.

9. High-voltage circuit breaker according to claim 1, wherein one of sulfur hexafluoride (SF6), nitrogen (N2), tetrafluoromethane (CF4) or a mixture thereof is used as the insulating gas.

10. High-voltage circuit breaker according to claim 2, wherein the at least one diverting device includes a plurality of openings.

11. High-voltage circuit breaker according to claim 5, wherein the openings are arranged offset relative to each other.

12. High-voltage circuit breaker according to claim 7, wherein the at least one diverting device is made of aluminum.

13. The High-Voltage circuit breaker of claim 1, wherein the at least one diverting device has one or more openings the sizes of which are configured such that an amount of the insulating gas diverted from the first gas flow reduces the first gas flow such that the first gas glow and the second gas flow are approximately the same with respect to at least one of volume and amount.

14. High-voltage circuit breaker filled with insulating gas, comprising:

two oppositely-arranged arcing contacts, surrounded by an insulating nozzle;

two oppositely-arranged main contacts, outside of the insulating nozzle, each oppositely-arranged main contact being assigned to one of the arcing contacts;

means for partitioning an insulating gas flow from a region between the two arcing contacts into first and second insulating gas flows of opposite directions, wherein the first and second insulating gas flows are conducted outside of the insulating nozzle from opposite directions toward the main contacts; and means for diverting insulating gas from the first insulating gas flow, such that the first and second insulating gas flows flowing from opposite directions toward the main contacts do not displace the insulating gas present in a region around the two main contacts, wherein the means for diverting insulating gas diverts insulating gas from the first insulating gas flow, such that the first and second insulating gas flows flowing from opposite directions toward the main contacts have approximately the same value with respect to at least one of volume and amount.

15. High-voltage circuit breaker according to claim 14, wherein the means for diverting includes an opening.

16. High-voltage circuit breaker according to claim 15, wherein the cross sectional surface of the opening is selected such that the two insulating gas flows flowing from the opposite directions toward the main contacts are approximately the same.

17. High-voltage circuit breaker according to claim 14, wherein the means for diverting includes a plurality of openings.

18. The High-Voltage circuit breaker of claim 14, wherein the means for diverting insulating gas has one or more openings the sizes of which are configured such that an amount of the insulating gas diverted from the first gas flow reduces the first gas flow such that the first gas glow and the second gas flow are approximately the same with respect to at least one of volume and amount.

19. High-voltage circuit breaker filled with insulating gas, comprising:

two oppositely-arranged arcing contacts, surrounded by an insulating nozzle;

two oppositely-arranged main contacts, outside of the insulating nozzle, each oppositely-arranged main contact being assigned to one of the arcing contacts;

at least one mechanism configured to partition an insulating gas flow from a region between the two arcing contacts into first and second insulating gas flows of opposite directions, wherein the first and second insulating gas flows are conducted outside of the insulating nozzle from opposite directions toward the main contacts; and at least one diverting device configured to reduce the first insulating gas flow by diverting insulating gas from the first insulating gas flow, such that the first and second insulating gas flows flowing from opposite directions toward the main contacts do not displace the insulating gas present in a region around the two main contacts, wherein the least one diverting device has one or more openings the sizes of which are configured such that an amount of the insulating gas diverted from the first gas flow reduces the first gas flow such that the first gas glow and the second gas flow are approximately the same with respect to at least one of volume and amount.

20. High-voltage circuit breaker filled with insulating gas, comprising:

two oppositely-arranged arcing contacts, surrounded by an insulating nozzle;

two oppositely-arranged main contacts, outside of the insulating nozzle, each oppositely-arranged main contact being assigned to one of the arcing contacts;

means for partitioning an insulating gas flow from a region between the two arcing contacts into first and second insulating gas flows of opposite directions, wherein the first and second insulating gas flows are conducted outside of the insulating nozzle from opposite directions toward the main contacts; and means for diverting insulating gas from the first insulating gas flow, such that the first and second insulating gas flows flowing from opposite directions toward the main contacts do not displace the insulating gas present in a region around the two main contacts, wherein the means for diverting insulating gas has one or more openings the sizes of which are configured such that an amount of the insulating gas diverted from the first gas flow reduces the first gas flow such that the first gas glow and the second gas flow are approximately the same with respect to at least one of volume and amount.

* * * * *